US007571678B2

(12) United States Patent
Petri

(10) Patent No.: US 7,571,678 B2
(45) Date of Patent: Aug. 11, 2009

(54) DISTRIBUTOR UNIT FOR LIQUID SUBSTANCES

(75) Inventor: Stefano Petri, Capannori (IT)

(73) Assignee: Fabio Perini, Viareggio (Lucca) (IT)

( * ) Notice: Subject to any disclaimer, the term of this patent is extended or adjusted under 35 U.S.C. 154(b) by 427 days.

(21) Appl. No.: 10/567,708

(22) PCT Filed: Dec. 22, 2004

(86) PCT No.: PCT/IT2004/000716

§ 371 (c)(1),
(2), (4) Date: Feb. 7, 2006

(87) PCT Pub. No.: WO2005/063488

PCT Pub. Date: Jul. 14, 2005

(65) Prior Publication Data

US 2006/0219110 A1 Oct. 5, 2006

(30) Foreign Application Priority Data

Dec. 31, 2003 (IT) ..... FI2003A0330

(51) Int. Cl.
*B41F 13/24* (2006.01)
*B41F 31/30* (2006.01)

(52) U.S. Cl. ..... 101/247; 101/216; 101/182; 101/352.01

(58) Field of Classification Search ..... 101/216, 101/151, 152, 174, 176, 178, 206, 213, 219, 101/247, 181–184, 352.01, 352.05; 384/24, 384/434, 436; *B41F 5/16*
See application file for complete search history.

(56) References Cited

U.S. PATENT DOCUMENTS 4,022,125 A * 5/1977 Weaver ..... 101/148

(Continued)

FOREIGN PATENT DOCUMENTS

EP 0 352 599 1/1990

(Continued)

*Primary Examiner*—Leslie J Evanisko
(74) *Attorney, Agent, or Firm*—McGlew and Tuttle, P.C.

(57) ABSTRACT

A distributor unit includes a reservoir (7) containing a liquid substance, an anilox cylinder (8) and a cliché cylinder (9) onto which is movably fitted a cliche jacket (18), the reservoir (7), the anilox cylinder (8) and the cliche cylinder (9) being movable from and to a cylinder (2) on which travels a web-shaped material (3) which has to receive the substance. The distributor unit has an operator side and a transmission side, the anilox cylinder (8) and the cliche cylinder (9) being held by corresponding supports on operator side (14, 15) and on transmission side (16, 17). A device (19) for locking the cliche cylinder in cantilever position when the corresponding cliche jacket (18) has to be substituted is associated to the support on transmission side (17) of the cliche cylinder (9). The support on operator side (15); of the cliche cylinder (9) includes a first and a second element (150, 151) automatically movable from and to the cliche cylinder (9). The elements in configuration of use hold the cylinder (9) on the operator side and, in a configuration of substitution of the cliche jacket (18), are reciprocally spaced disengaging the operator side of the cliche cylinder (9).

20 Claims, 12 Drawing Sheets

U.S. PATENT DOCUMENTS

| | | | | | |
|---|---|---|---|---|---|
| 4,807,527 | A | * | 2/1989 | Knauer | 101/216 |
| 5,617,789 | A | * | 4/1997 | Achelpohl et al. | 101/216 |
| 5,628,868 | A | * | 5/1997 | Marschke et al. | 156/578 |
| 5,802,975 | A | * | 9/1998 | Prem et al. | 101/375 |
| 6,142,073 | A | * | 11/2000 | Zeman et al. | 101/216 |
| 6,615,716 | B1 | * | 9/2003 | Freddo et al. | 101/216 |

FOREIGN PATENT DOCUMENTS

| | | |
|---|---|---|
| EP | 0 596 244 | 5/1994 |
| EP | 0 640 812 | 3/1995 |
| EP | 0 678 381 | 10/1995 |
| EP | 0 741 099 | 11/1996 |

* cited by examiner

DISTRIBUTOR UNIT FOR LIQUID SUBSTANCES

CROSS REFERENCE TO RELATED APPLICATIONS

This application is a U.S. National Phase application of International Application PCT/IT2004/000716 and claims the benefit of priority under 35 U.S.C. § 119 of Italian Patent Application FI2003000330 filed Dec. 31, 2003.

FIELD OF THE INVENTION

The present invention relates to a distributor unit for liquid substances utilizable especially, even if not exclusively, as colour unit for printing machines used for executing print on continuous web-shaped material such as tissue paper for the production of kitchen paper rolls, paper napkins, handkerchiefs, toilet paper and the like.

BACKGROUND OF THE INVENTION

It is known that the printing machines utilized for executing prints of the above mentioned type, also called flexographic printing machines, comprise a drum around which the web travels and at least one cliche cylinder, on which the printing ink is distributed and from which the ink is transferred to the web to be printed. In order to obtain the distribution of the ink on the cliche cylinder, it is used an unit, commonly called "colour unit", comprising a reservoir for the ink or "fountain", a distributor cylinder or "anilox cylinder" which receives the ink from the reservoir and transfers it by contact to the cliche cylinder, and two blades, or doctors, disposed and acting between the fountain and the anilox cylinder.

In FIG. 1 is represented, schematically, a typical flexographic printing machine with four colour units. In this scheme, (RI) indicates the transmission roll onto which the web (N) to be printed travels, which moves in the direction of the arrow (Z); (C), (D) and (E) indicate three guiding rolls of the web (N) disposed upstream of the roll (RI); (F) and (G) indicate two guiding rolls of the web (N) disposed downstream of the roll (RI); (H), (L), (P) and (Q) indicate four identical colour units symmetrically disposed around the roll (RI); (CD) indicates an anilox cylinder; (CL) indicates a cliche cylinder, (LS) and (LI) indicate two doctors disposed and acting between the fountain (U) and the anilox cylinder (CD); (S) indicates a support structure of the doctors (LS, LI). The two doctors delimitate, in cooperation with the structure (S) and the surface of the anilox cylinder (CD), the fountain (U) in which is contained the ink for the same cylinder (CD). The two opposite bases of the fountain (U) are closed by relevant tight plates or gaskets. (M) indicates the rotation direction of the roll (RI).

The cliche cylinder is constituted by a cylindrical body with smooth surface, onto which there is movably fitted a jacket provided with reliefs acting to form the patterns and the writings to be printed. In such way, for varying the printing effects, it is sufficient to remove the jacket from the cylinder and to substitute it with a different jacket, afterwards called "cliche jacket".

This operation concerns, mostly, all the colour units of the machine. The latter is stopped during the substitution of the cliche jackets, with a loss of production corresponding in extent to the time required for the substitution.

In order to substitute of the cliche jacket, it is necessary that the operator dismounts the support of the cylinder utilizing, at least in part, manual tools; this requires a time as great or as small as the skill of the operator and it can involve risks of damage for the parts which are dismounted and afterwards remounted.

The same drawbacks relates to the distributor units utilized, for example, for distributing glue or other liquid substances on web-shaped materials in movement and structured as the before said colour units, that is provided with a cylinder onto which it is movably fitted a jacket (called also in this case "cliche-jacket" because it is provided with reliefs apt to allow the distribution of the substance only on preset points of the web and not over the whole surface of the same) and a distributor cylinder which receives the substance from a relevant reservoir and, by contact, transfers it to the cliche cylinder.

Distributor units are described in U.S. Pat. No. 6,615,716, EP741009 and EP596244.

SUMMARY OF THE INVENTION

The main object of the present invention is to provide a distributor unit, especially a color unit for printing machines, suitably structured in order to shorten and facilitate the substitution of the cliche-jackets.

This result has been achieved, according to the invention, by making a distributor unit having the characteristics discussed herein.

The present invention makes it possible to obtain a remarkable reduction of the time required for the substitution of the cliche-jackets, with a correspondent reduction of the loss in the production due to the stop of the machine; this advantage is even more evident with a greater number of distributor units involved by this operation.

Furthermore, a device according to the present invention is relatively simple to be manufactured, it is more easily and more safely usable, and it is reliable also after a prolonged use.

These and other advantages and characteristics of the invention will be best understood by anyone skilled in the art from a reading of the following description in conjunction with the attached drawings given as a practical exemplification of the invention, but not to be considered in a limiting sense. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

The term "operator side" means the side from which an operator can extract a cliche-jacket from a corresponding cylinder and substitute it with another cliche-jacket. The term "transmission side" means the opposite side of the machine, that is the side in correspondence of which are positioned the motors which operate the rotation of the cliche-cylinders or rolls and of the anilox rolls or cylinders. The term roll or cylinder means, according to that said above, a cylindrical body with a smooth or substantially smooth surface, onto which a tubular jacket provided with reliefs may be fitted. Said tubular jacket will be called "cliche-jacket" (independently of the fact that the substance to be distributed is ink or other).

Figure 1:
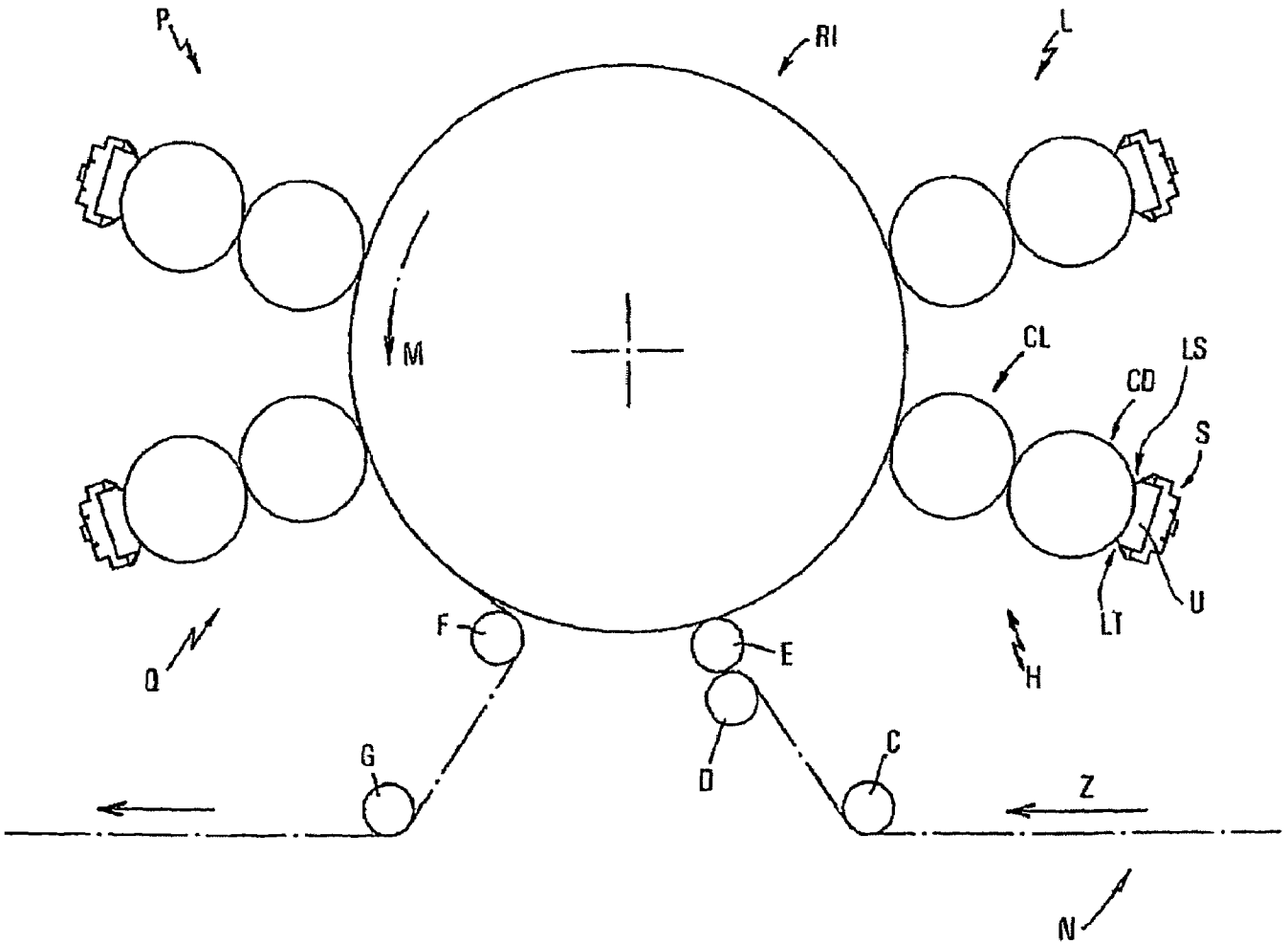
Fig. 1 (PRIOR ART)
FIG. 1 is a schematic view showing a typical flexographic printing machine with four colour units.
Figure 2:
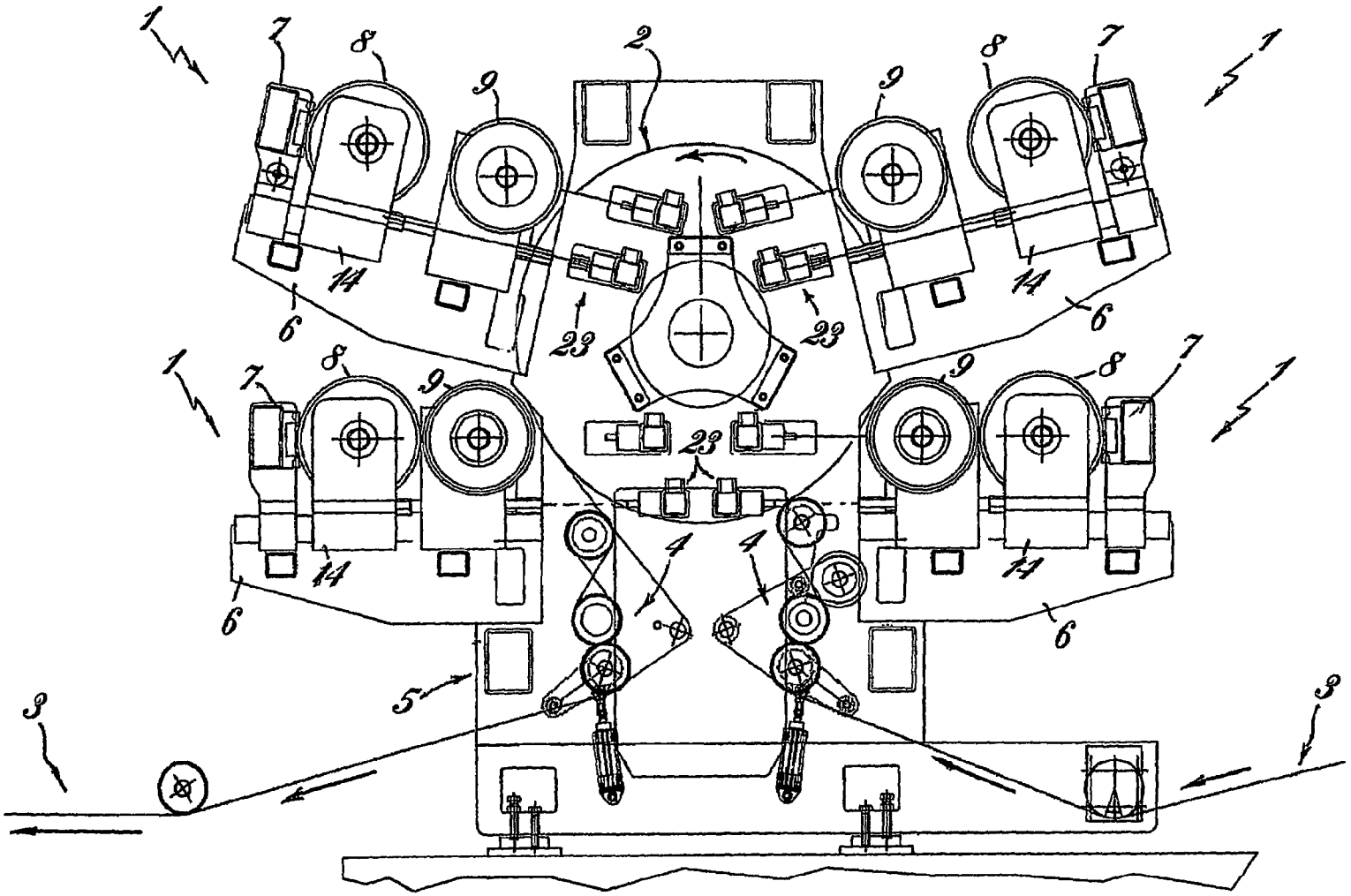
FIG. 2 is a schematic view like that of FIG. 1, but it refers to a machine provided with four color units according to the present invention.
Figure 3:
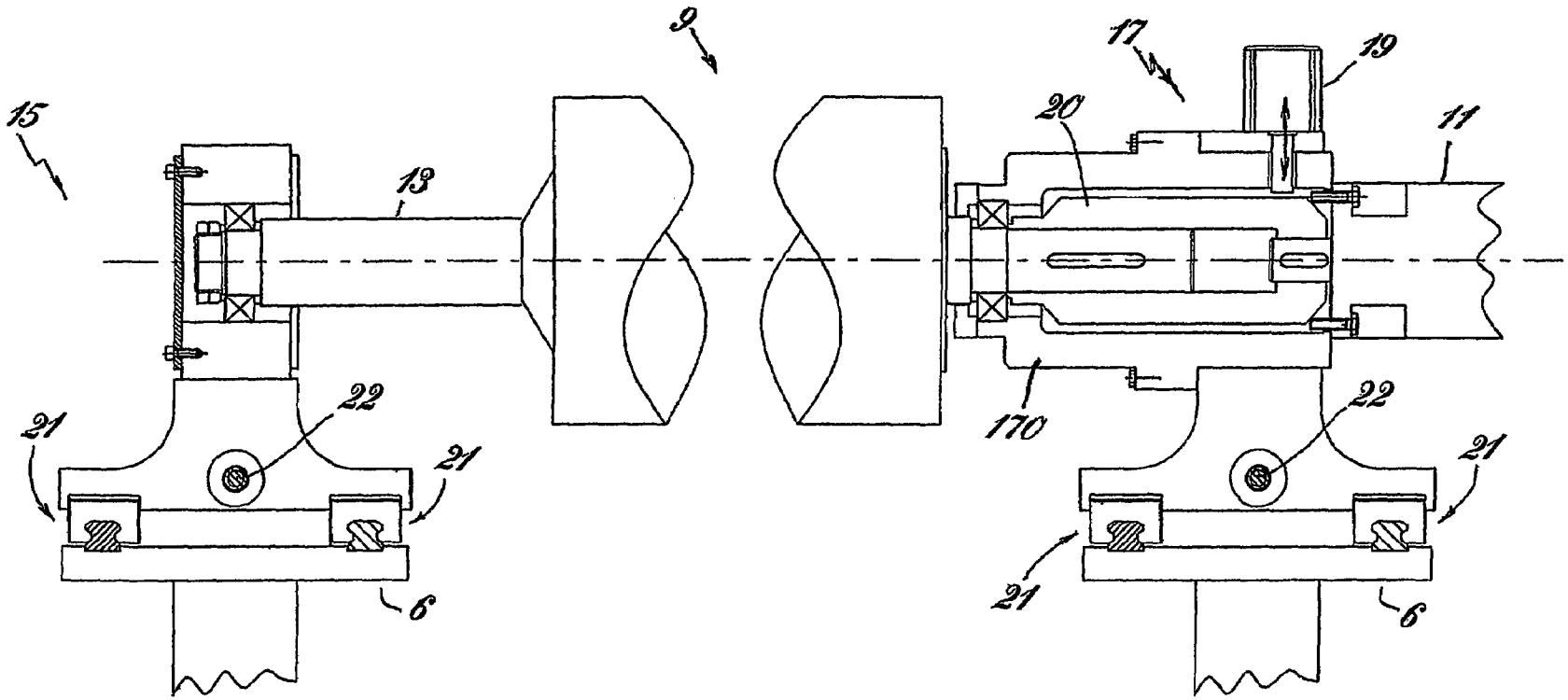
FIG. 3 is a schematic view in cross section of the supports of a cliche-cylinder or roll of a color unit according to the invention.
Figure 4:
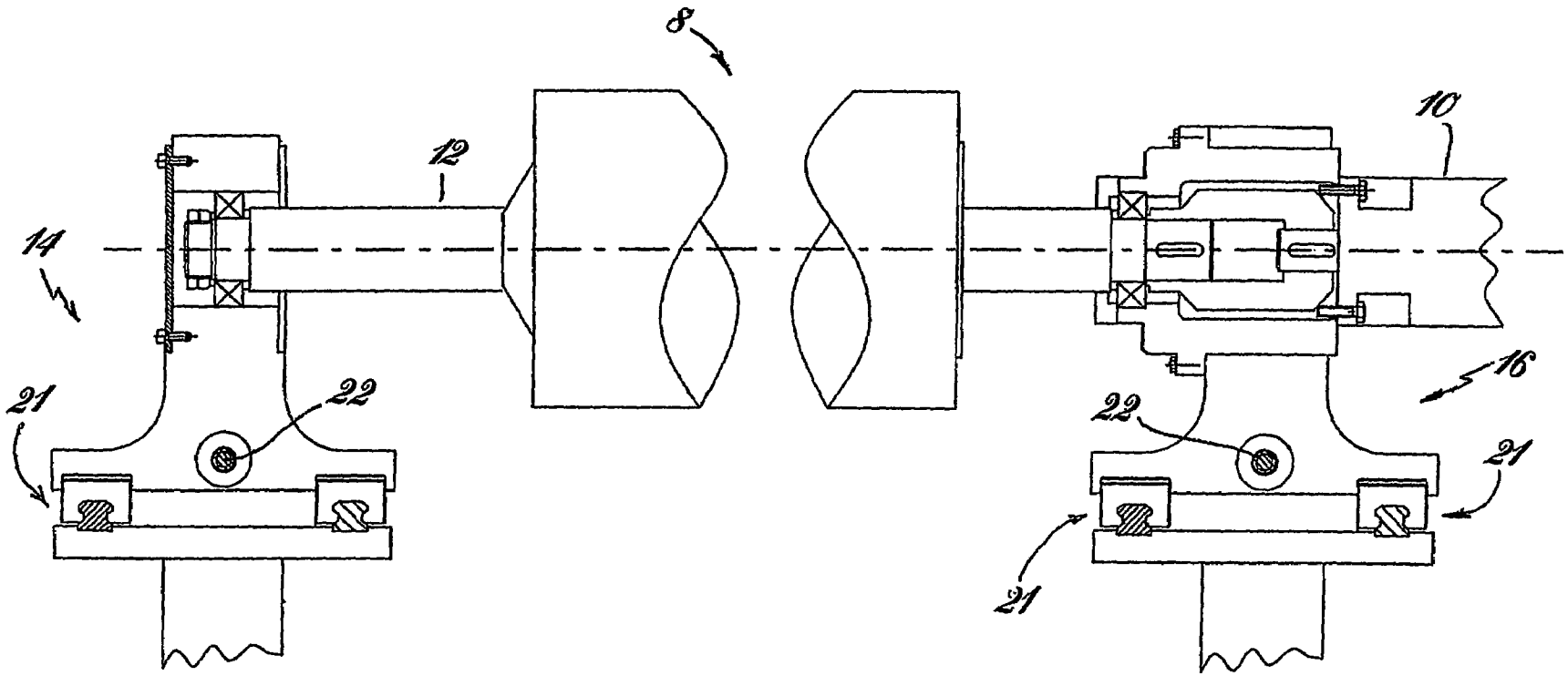
FIG. 4 is a schematic view in cross section of the supports of an anilox cylinder or roll of a color unit according to the invention.
Figure 5:
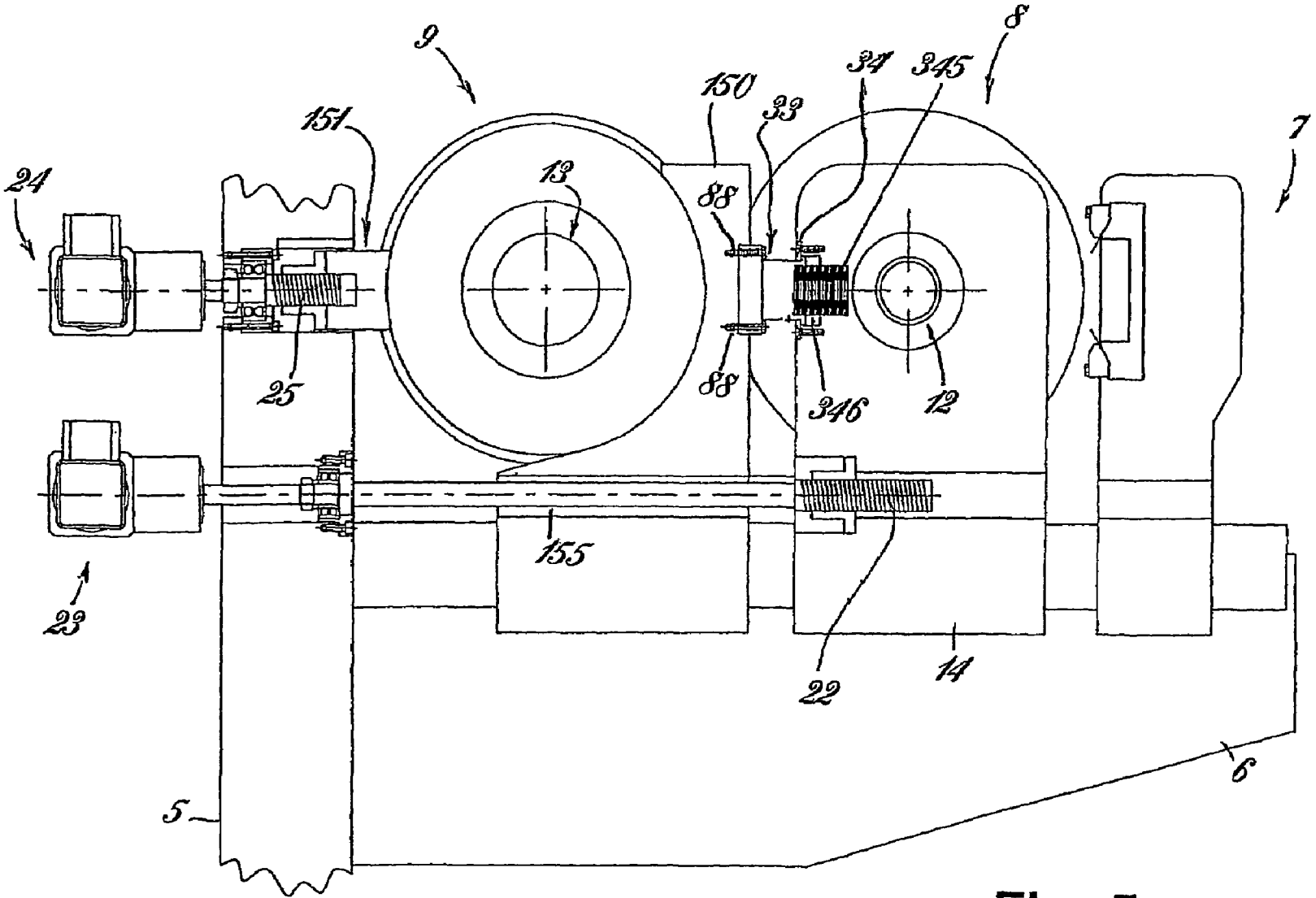
FIG. 5 is a schematic view in cross section of a color unit according to the invention, seen from the operator side and in an arrangement of complete rest of the cliche roll on the relevant support on the operator side.
Figure 6:
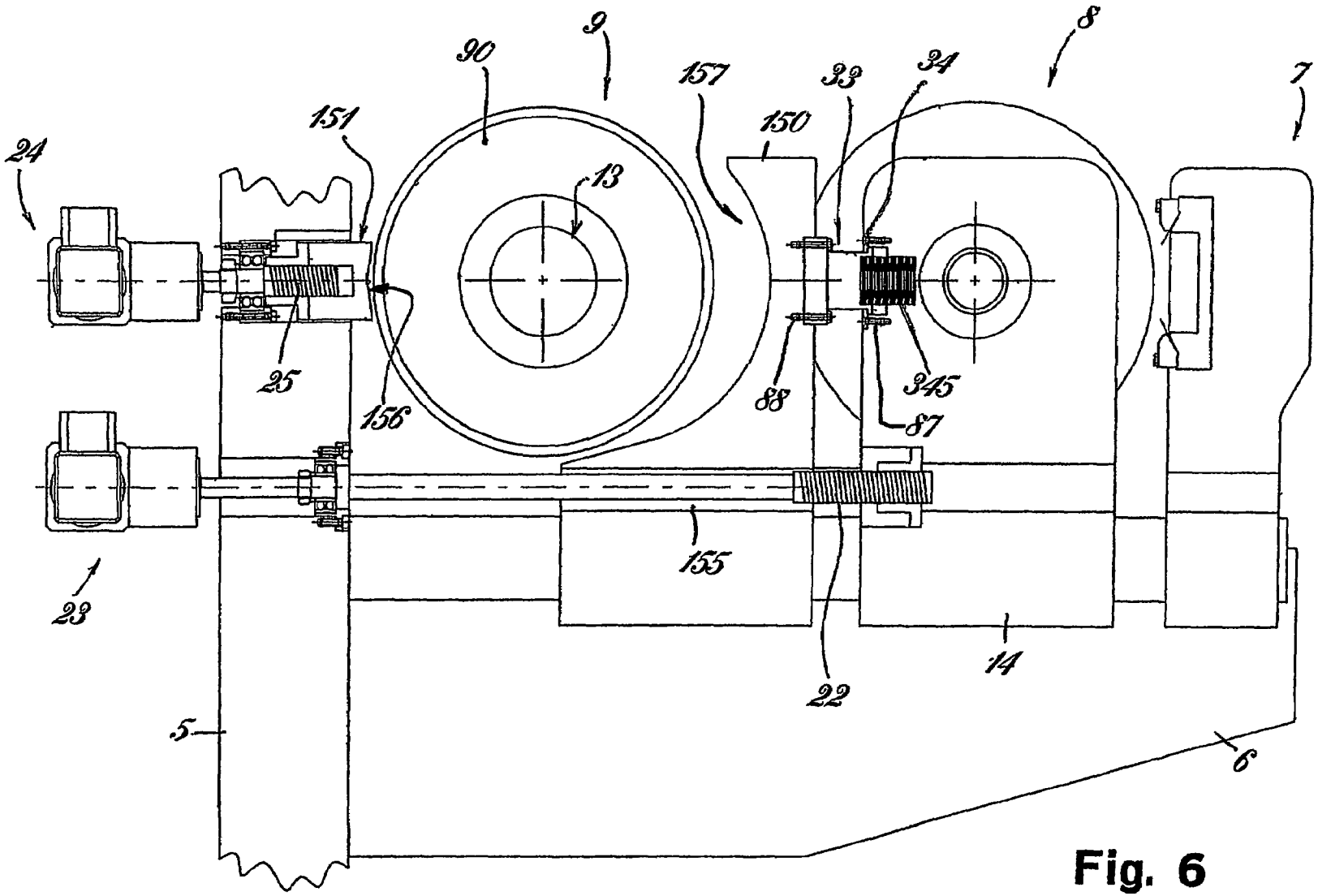
FIG. 6 is a view like to that of FIG. 5, but with the said support shown in a disengaged arrangement.
Figure 7:
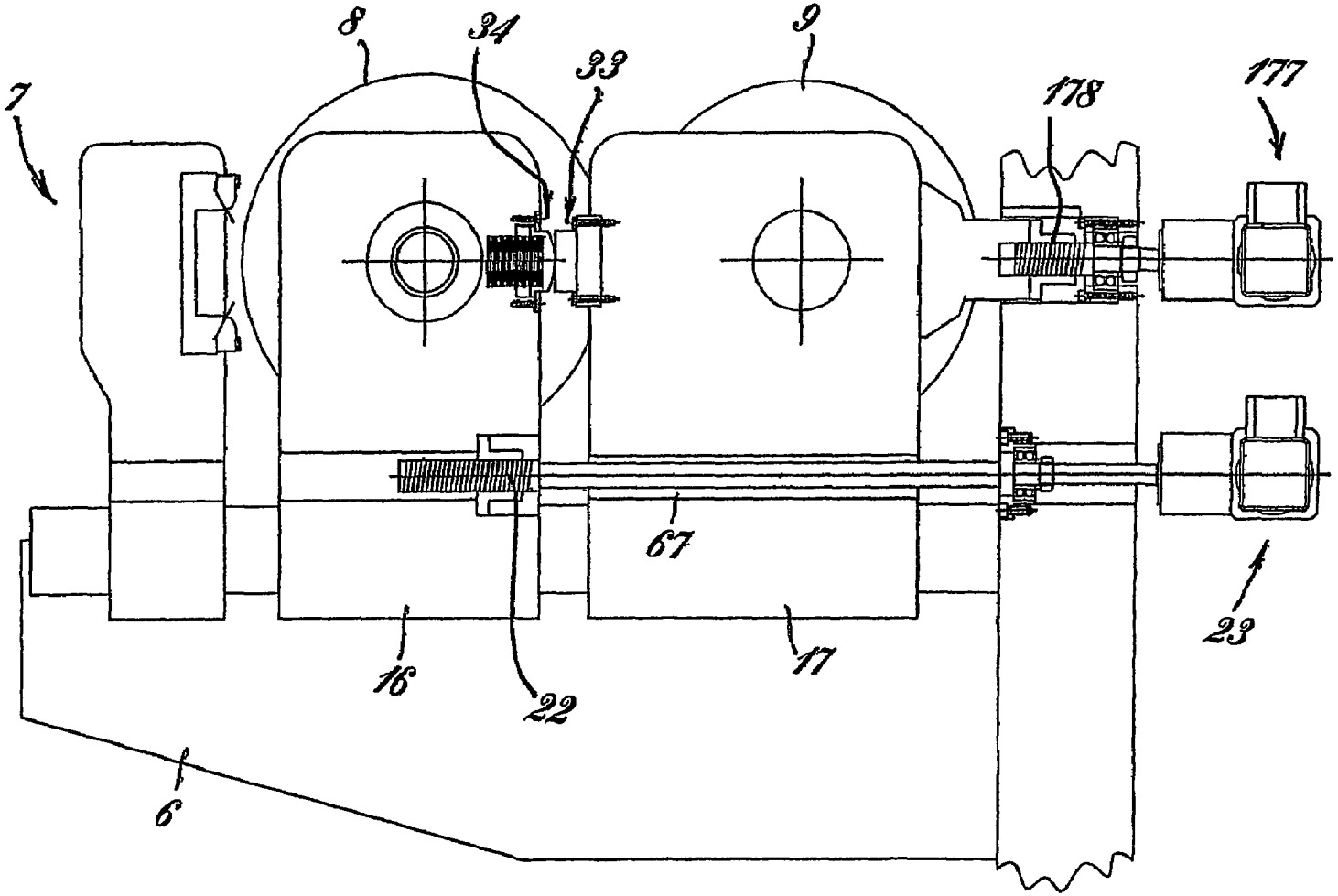
FIG. 7 is a sectional view like to that of FIG. 5, but with the color unit seen from the transmission side.
Figure 8:
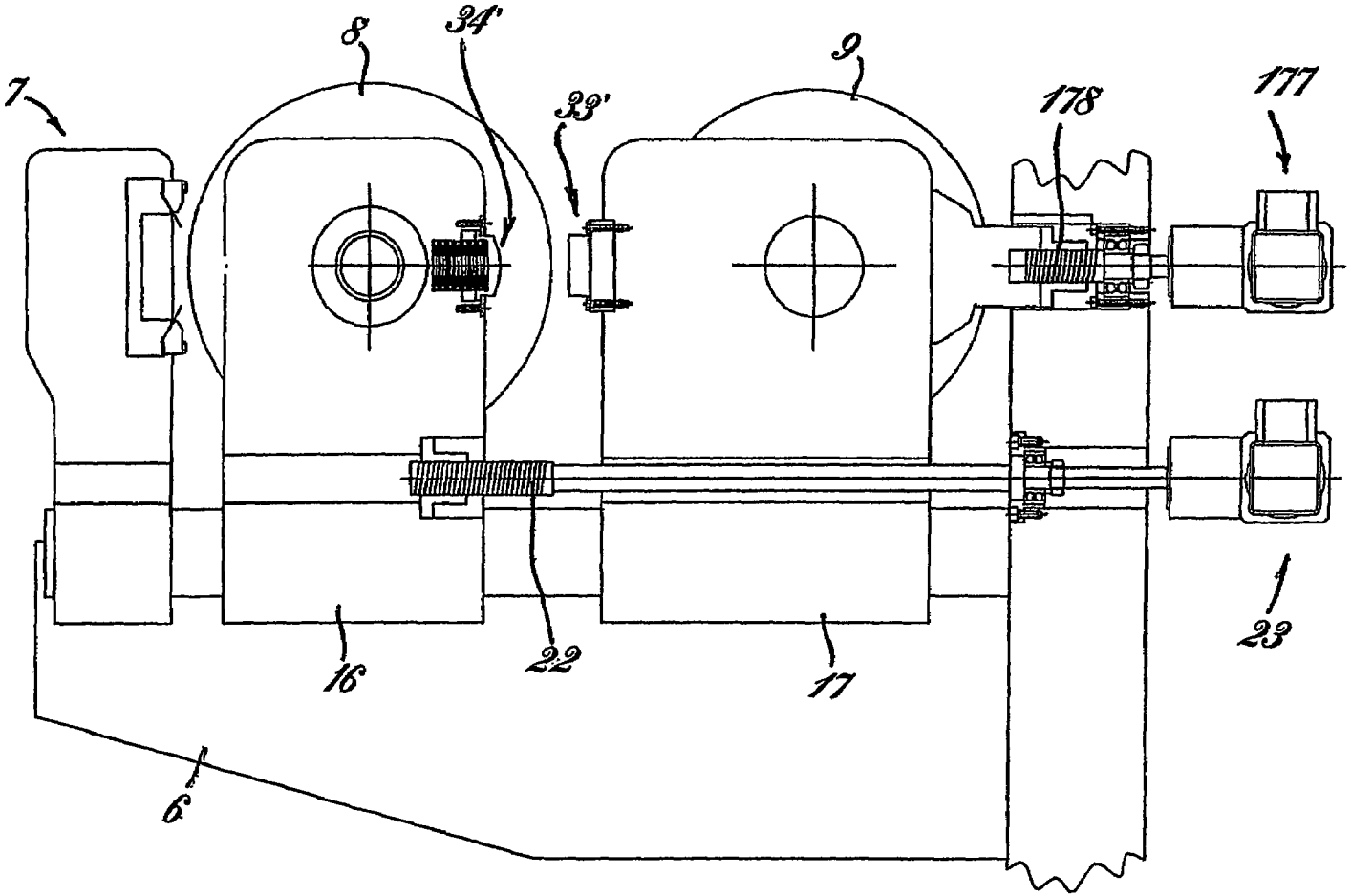
FIG. 8 is a sectional view like to that of FIG. 6, but with the color unit seen from the transmission side.
Figure 9:
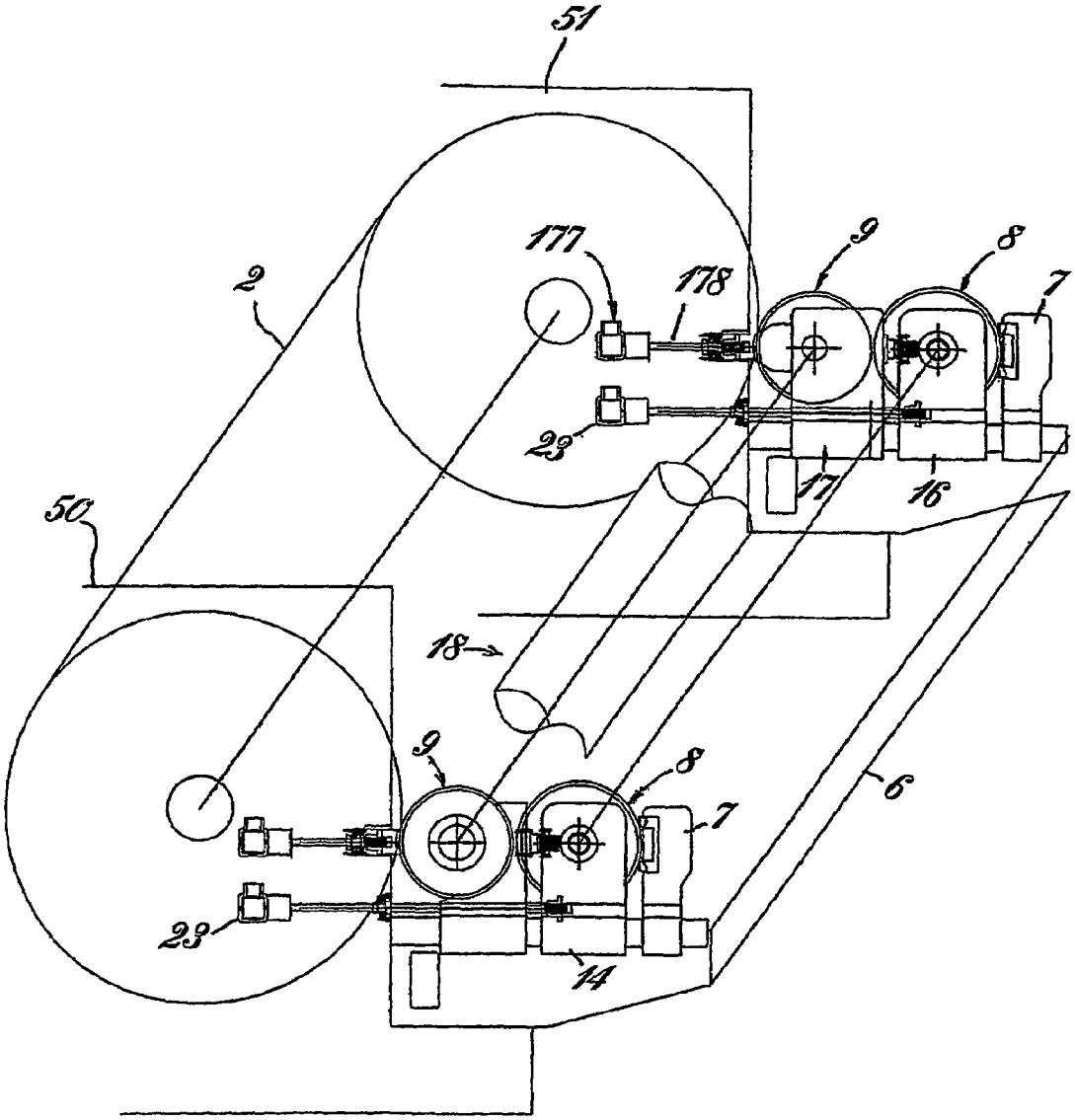
FIG. 9 is a schematic and partial perspective view of the machine of FIG. 2 in operative arrangement, with some, removed parts for a better representation of others.
Figure 10:
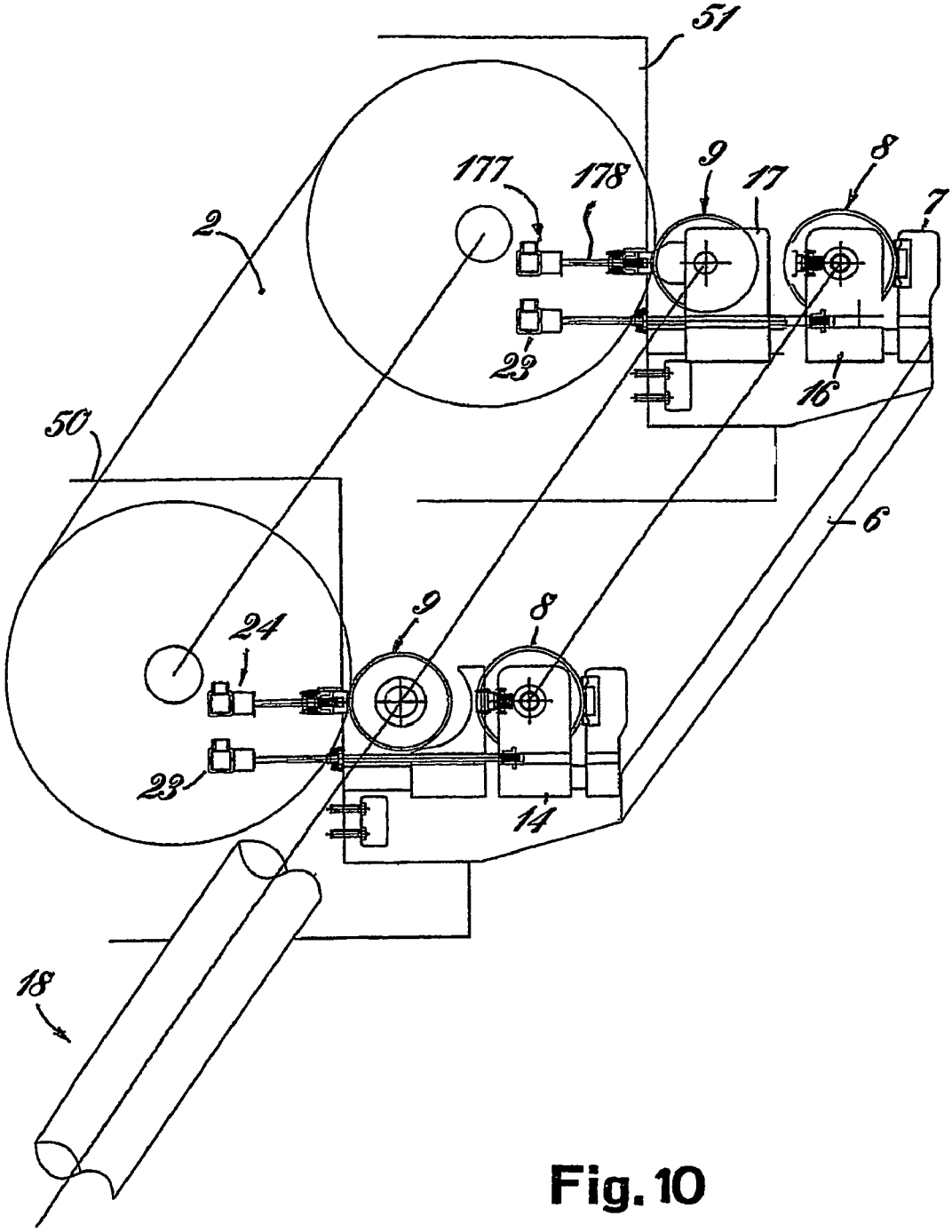
FIG. 10 is a view like to that of FIG. 9, with the supports of the cylinders of a color unit in the arrangement of allowed extraction of a cliche jacket.
Figure 11:
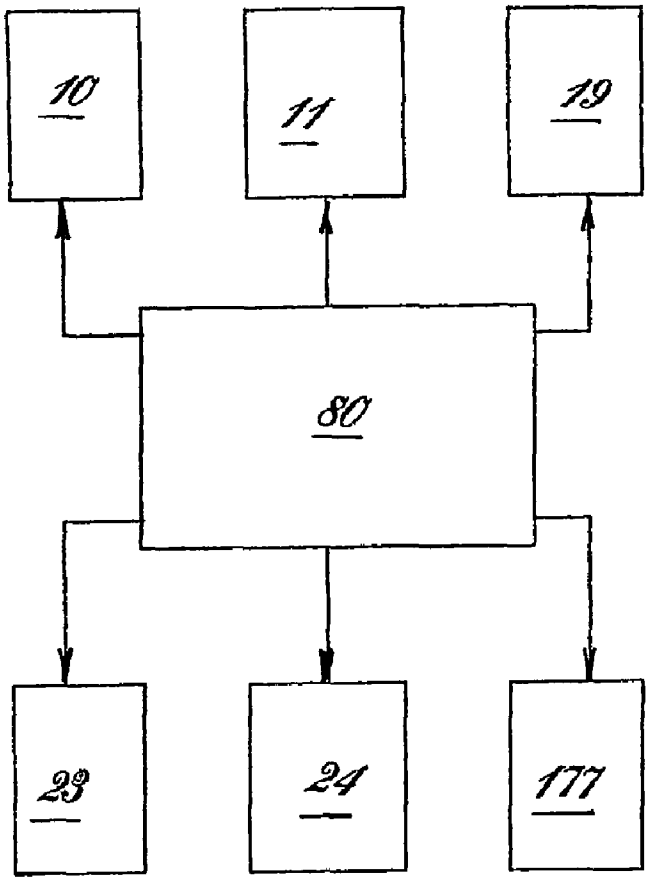
FIG. 11 is a simplified block diagram of the system of control of actuators.
Figure 12:
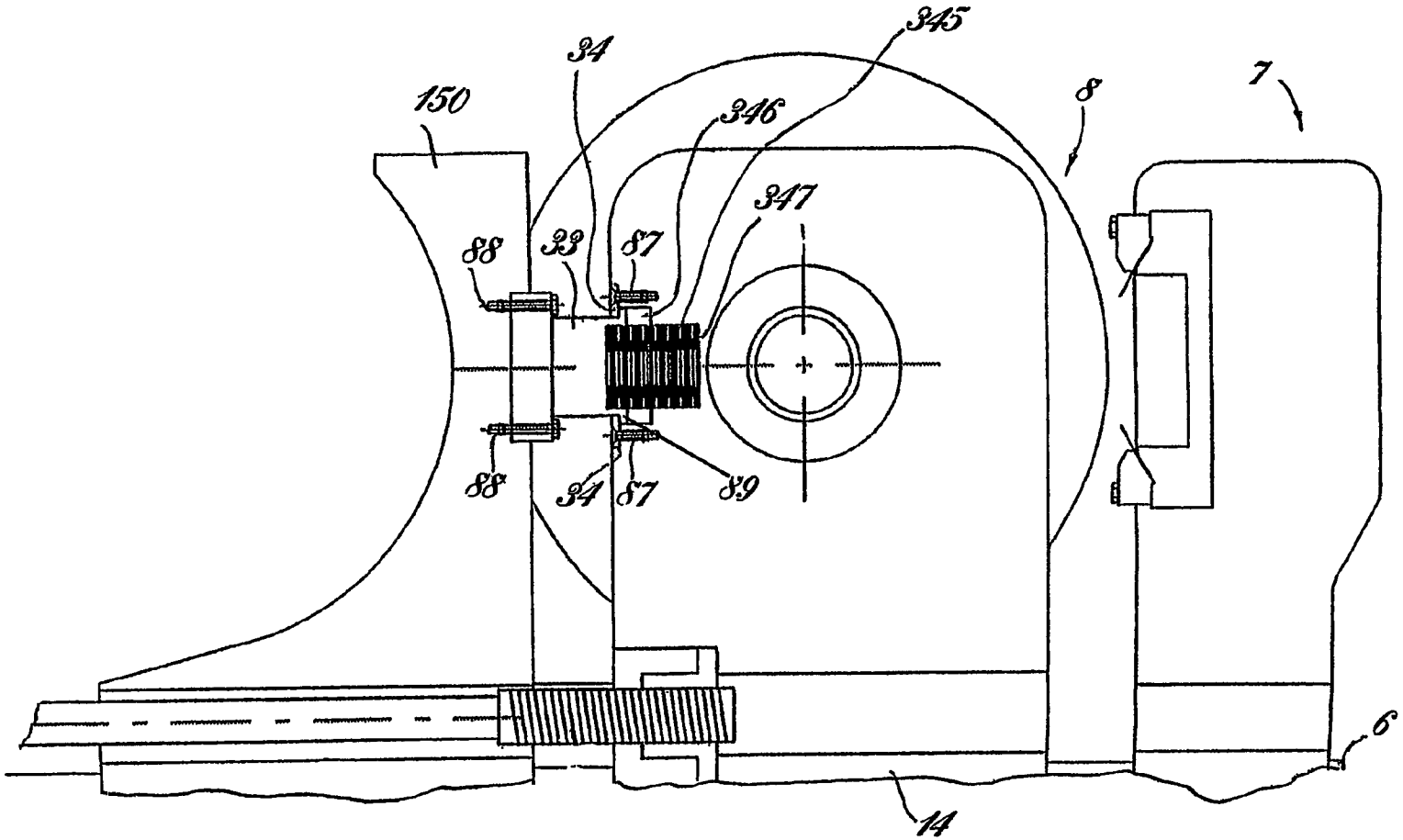
FIG. 12 is an enlarged view showing particulars of FIG. 5.

In the enclosed drawings (FIGS. 2-12) there is represented a printing machine with four color units (1) disposed symmetrically around a transmission cylinder (2) for a web (3) of paper material on which is executed the print. The present machine is also provided with a series of guiding rolls (4) for the web (3), said guiding rolls being disposed upstream and downstream of the cylinder (2), said rolls (4) being associated to a fixed structure (5) which supports also the cylinder (2) and supports, by means of corresponding brackets (6), the color units (1).

Each color unit (1) is disposed on a relevant bracket (6) of the structure (5) and comprises a reservoir (7) or "fountain" for the ink, an anilox cylinder (8) and a cliche cylinder (9) which is disposed adjacent to the transmission cylinder (2), so that the web (3) on which the print has to be executed results between the cliche cylinder and the transmission cylinder. As in the conventional systems, the anilox cylinder (8) and the cliche cylinder (9) are associated to corresponding electric motors (10, 11), in order to drive the rotation thereof around the respective longitudinal axis; said axis are parallel each other and to the rotation axis of the transmission cylinder (2). The cliche cylinder (9) is of the type constituted by a cylindrical body with smooth or substantially smooth surface, onto which it is fitted a cliche jacket (18). The anilox cylinder (8) receives the ink from the fountain (7) and it transfers the same, by contact, to the cliche cylinder (9) which, in turn, executes a print on the web (3) that travels on the transmission cylinder (2).

The anilox cylinder (8) and the cliche cylinder (9) have corresponding shafts or axis (12,13) extending both towards the operator side and the transmission side of the machine.

The shafts (12,13) rest on corresponding supports on the operator side (14,15) and on the transmission side (16,17), mounted on the relevant bracket (6). More particularly, the shaft (12) of the anilox cylinder (8) rests always on the relevant supports (14) and (16), while the shaft (13) of the cliche cylinder (9) rests on both the supports (15) and (17) only during the printing operation: said shaft (13) being locked in "cantilever" position to the support (17) of transmission side and free on operator side during the extraction and the substitution of the respective cliche jacket (18), as better explained afterwards.

For blocking the cliche cylinder (9) in cantilever position, can be used, for example, a piston (19) fixed to the support of the same cylinder (9) on the transmission side (17); the stem of said piston is oriented radially with respect to the shaft (13) and is able to lock a sleeve (20) keyed on the rear portion of the shaft (13) of the cylinder (9), that is keyed on the portion of the shaft (13) connected to the motor (11). When the stem of the piston (19) is extracted, the shaft (13) is locked to the support (17), so that, according to the manner described afterwards, the part of the same shaft on operator side can be unlocked from the support (15) and it is possible to substitute the jacket (18). In use, or during the printing, the stem of the piston (19) is retracted and the shaft (13) rests on both the relevant supports (15) and (17), free to rotate around its longitudinal axis.

Both the support on operator side (14) and the support on transmission side (16) of the anilox cylinder (8) are movable on the bracket (6), being mounted on rectilinear guides (21) which are parallel to each other, solid to the bracket (6), orthogonal to the longitudinal axis of the fountain (7), of the anilox cylinder (8) and of the cliche cylinder (9), and on which guides said supports (14,16) are movable thanks to two corresponding screw controls (22) each of which engages, centrally, the base portion of a respective support (14,16) and is operated by an electric motor (23). The rotation of said motors causes the approach of the supports (14,16), and, then, the approach of the anilox cylinder (8) to the cliche cylinder (9) and, vice versa, their spacing. Said motors (23) are solid to said structure (5) and are disposed in correspondence of two heads (50,51) of the same: a motor (23) being disposed on the head on operator side (50), the other motor (23) being disposed on the head on transmission side (51).

Advantageously, according to the invention, the support on operator side (15) of the cliche cylinder (9) comprises two elements (150,151) which, in the normal operative configuration of the machine, that is during the printing, are closed to the cylinder (9), forming a corresponding support on which the shaft (13) of the cylinder (9) is free to rotate around its longitudinal axis. In the configuration of allowed extraction of the cliche jacket (18), with the cliche cylinder (9) in cantilever position (that is locked to the respective support on transmission side 17 by the piston 19), said two elements (150,151) are spaced from the cylinder (9).

According to the embodiment shown in the enclosed drawings, an element (150) of the said support on operator side (15) is connected to the support on operator side (14) of the anilox cylinder (8) and is mounted slidable on the same guides (21), so that the motion of the support (14) determines the motion of the element (150). For example, the connection between said element (150) and the support on operator side (14) of the anilox cylinder (8) can be obtained by connecting, by means of two or more screws (88), a lateral rigid appendix (33) of the element (150) with the support (14), so that a portion (89) of the connecting appendix (33) is in a corresponding receiving seat (346) formed in the support (14). Preferably, said appendix (33) is shaped tubular or cylindrical or prismatic, the relevant portion (89) inside the support (14) is shaped as a flange and the seat (346) of the support (14) which receives the flange (89) has, on the side facing the element (150), a closing frame (34) which prevents the flange (89) to escape. Said frame (150) is fixed to the support (14) by screws (87) and it is in contact with the flange (89). More in particular, the frame (150) is in contact with the surface of the flange which faces the outside of the seat (346), that is facing the element (150).

In the same seat (346) of the support (14) which receives said flange (89) of the lateral appendix (33) of the element (150), is disposed a spring (345) positioned between the bottom (347) of the seat (346) and the appendix (33).

The screw (22) which activates the movement of the front support (14) of the anilox cylinder (8) passes, free to rotate around its axis, through an aperture (155) of the element (150). The second movable element (151) of the front support (15) of the cliche cylinder (9) is linked to a corresponding electric motor (24) which is able to operate its translation from and to the cylinder (9) by means of a corresponding screw control (25).

The elements (150,151) define, as said above, the front support (15) of the cliche cylinder (9), forming, by means of respective concavities (156,157) facing the same cylinder (9), two separable rests, diametrically opposed, for a front end flange (90) of the cliche cylinder (9): said flange (90) containing a bearing of the shaft (13) of the cliche cylinder (9). In other words, the front end of the cylinder (9) is provided with a flange (90) which, during the printing, lies on the concavity (157) of the element (150) in cooperation with the element (151) which is in contact with the flange (90) on diametrically opposite side (see FIG. 5). Vice versa, in configuration of release of the front end of the cylinder (9), both the elements (150,151) are spaced from the cylinder (9) (see FIG. 6). The spacing of the element (151) from the flange (90) of the cylinder (9) is operated directly by the relevant motor (24). The spacing of the element (150) from the flange (90) of the cylinder (9) is determined by the rearwards motion of the support (14) which is linked to it and which drives it with itself under control of the relevant motor (23).

The support on the transmission side (16) of the anilox cylinder (8) is structurally identical to that on operator side (14).

The support on the transmission side (17) of the cliche cylinder (9) is made by one element, with a tubular appendix (170) facing the cylinder (9); said appendix delimitates a seat for a corresponding portion of the relevant shaft (13) and for said sleeve (20), onto which the stem of the piston (19) pushes when it is necessary to block the cylinder (9) in cantilever position. On opposite side regards to said tubular appendix (170), it is fixed the casing of the motor (11) which operates the rotation of the cylinder (9).

The support (17) is linked to a corresponding electric motor (177) by means of a screw control (178) in order to allow the motion of the same support along said guides (21) when it is necessary to space the same from the transmission cylinder (2) and, afterwards, for repositioning it in operative configuration.

The supports on the transmission side (16,17) of the anilox cylinder (8) and cliche cylinder (9) are provided, respectively, with an elastic stop (34') and with a rigid stop (33'). Said supports (16) and (17) aren't linked to each other, being independent to each other.

The screw (22), which connects the support on the transmission side (16) of the anilox cylinder (8) with the relevant motor (23), passes, free to rotate around its longitudinal axis, trough a respective aperture (67) provided by the support on the transmission side (17) of the cliche cylinder (9).

The fountain (7) is also mounted movable on said guides (21) for allowing to approach it to the anilox cylinder (8) and to space it when necessary, as provided for the color units of the conventional printing machines.

The actuators (10,11, 19,23, 24,177) are connected to a programmable electronic unit (80) of a type known to the technicians of the industrial automation art and, for this reason, not described in detail. The electronic unit (80), on command by the operator, automatically controls the motions described above and further described afterwards.

For extracting a cliche jacket (18) from the cylinder (9) of a color unit (1) to substitute the jacket extracted with another, with the machine stopped occurs what is described afterwards.

The unit (80) activates the piston (19) which, acting on the sleeve (20) keyed on the shaft (13), locks the latter in cantilever position. In concomitance with this operation, the unit (80) activates the motors (23) which, by means of the screws (22), move backwardly the supports (14) and (16) of the anilox cylinder (8). The fountain (7) moves backwardly as a consequence of the push exerted on it by the supports (14) and (16). The element (150) of the front support (15) of the cliche cylinder (9) is moved by the front support (14) of the anilox cylinder (8) since it is linked to the same. The element (151) of the support (15) is spaced from the cylinder (9) by means of the relevant motor (24). The support on the transmission side (17) of the cliche cylinder (9) is spaced from the transmission cylinder (2) by the relevant motor (177). At this point, the end on the operator side of the cylinder (9) is free, and the cliche jacket (18) can be freely extracted and substituted (in a manner known by the technicians and, therefore, not described in greater detail).

For repositioning the color unit in the operative configuration, the unit (80) operates the inversion of the above mentioned movements, and all the supports (14,15, 16, 17) are brought back in their initial positions and arrangements and, afterwards, the piston (19) releases the shaft (13) which, at this point, rests, free to rotate, on the relevant supports on operator and transmission side. The repositioning of the element (150) of the support (15) in operative arrangement-after the motor (177) has brought back the support (17) in the respective initial position-is determined by the advancement of the support (14) which pushes it toward the cylinder (9) until the re-establishment of the contact between the flange (90) of the latter and the element (151), the position of which constitutes a stop for the unit, and, in particular, for the cliche cylinder (9), traveling toward the transmission cylinder (2). In operative configuration, the elastic stop (34') of the support (16) is compressed on the lateral rigid stop (33') of the support (17) and the spring (345) contained in the support (14) is also compressed, so assuring always the contact between the flange (90) of the cylinder (9) and the element (151).

Although the preceding description is referred to a color unit of printing machines, as anticipated, a device according to the present invention is advantageously applicable to the cases in which the substance to be applied isn't ink but a substance of different type (i.e. glue, softening liquids or other) to be applied in preset points or zones of a web-shaped material, especially a paper web, by means of a cylinder provided with a cliche jacket movably fitted on it, jacked on which the substance is transferred by means of the contact with a distributor cylinder which receives the substance from a corresponding reservoir. In this case, the reservoir will contain glue, softening substances or other, instead of ink.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

While specific embodiments of the invention have been described in detail to illustrate the application of the principles of the invention, it will be understood that the invention may be embodied otherwise without departing from such principles.

The invention claimed is:

1. A distributor unit for cooperation with a transmission cylinder on which travels a web-shaped material which has to receive a substance, the distributor unit having an operator side and a transmission side, the distributor unit comprising:

a reservoir containing the substance;

an anilox cylinder;

a cliché cylinder onto which is movably fitted a cliché jacket, said reservoir, said anilox cylinder and said cliché cylinder being movable from and to said transmission cylinder;

an operator side support holding said anilox cylinder;

an operator side support holding said cliché cylinder;

a transmission side support holding said anilox cylinder;

a transmission side support holding said cliché cylinder;

a locking device for locking said cliché cylinder in a cantilever position in a substitution state when said corresponding cliché jacket has to be substituted, said locking device being associated with said transmission side support of said cliché cylinder, said operator side support of said cliché cylinder comprising a first element and a second element automatically movable from and to said cliché cylinder, said first and second elements holding said cliché cylinder on said operator side in a use state and said first and second elements are reciprocally spaced disengaging said operator side of said cliché cylinder in said substitution state;

an actuator associated with said second element for controlling movement of said second element from and to an axis of said cliché cylinder, said second element comprising a stop for limiting a movement of the distributor unit towards the transmission cylinder; and an elastic means interposed between said an appendix of said first element and said operator side support of said anilox cylinder.

2. A distributor unit according to claim 1, wherein said distributor unit comprises a color unit for printing machines and said the substance contained in said reservoir comprises an ink.

3. A distributor unit according to claim 1, wherein the substance contained in said reservoir comprises a glue.

4. A distributor unit according to claim 1, wherein the substance contained in said reservoir is a softening liquid.

5. A distributor unit according to claim 1, wherein said first element is linked to said operator side support of said anilox cylinder by a linkage, whereby motion of said operator side support of said anilox cylinder causes movement of said first element.

6. A distributor unit according to claim 5, wherein said linkage between said first element and operator side support of said anilox cylinder comprises a lateral rigid appendix of said first element, said appendix being connected to said operator side support of said anilox cylinder.

7. A distributor unit according to claim 1, wherein said first and second elements are disposed on opposite sides in respect to said cliché cylinder.

8. A distributor unit according to claim 1, wherein said transmission side support holding said anilox cylinder and said transmission side support holding said cliché cylinder are independent from each other and respectively provided with an elastic stop and with a rigid stop.

9. A distributor unit according to claim 1, wherein said first element is provided with a concavity facing said cliché cylinder.

10. A distributor unit for cooperation with a transmission cylinder on which travels a web-shaped material which has to receive a substance, the distributor unit having an operator side and a transmission side, the distributor unit comprising:

a reservoir containing the substance;

an anilox cylinder;

a cliché cylinder onto which is movably fitted a cliché jacket, said reservoir, said anilox cylinder and said cliché cylinder being movable from and to said transmission cylinder;

an operator side support holding said anilox cylinder;

an operator side support holding said cliché cylinder;

a transmission side support holding said anilox cylinder;

a transmission side support holding said cliché cylinder;

a locking device for locking said cliché cylinder in a cantilever position in a substitution state when said corresponding cliché jacket has to be substituted, said locking device being associated with said transmission side support of said cliché cylinder, said operator side support of said cliché cylinder comprising a first element and a second element automatically movable from and to said cliché cylinder, said first and second elements holding said cliché cylinder on said operator side in a use state and said first and second elements are reciprocally spaced disengaging said operator side of said cliché cylinder in said substitution state;

an actuator associated with said second element for controlling movement of said second element from and to an axis of said cliché cylinder, said second element comprising a stop for limiting a movement of the distributor unit towards the transmission cylinder, said first element being linked to said operator side support of said anilox cylinder by a linkage whereby motion of said operator side support of said anilox cylinder causes movement of said first element.

11. A distributor unit according to claim 10, wherein said linkage between said first element and operator side support of said anilox cylinder comprises a lateral rigid appendix of said first element, said appendix being connected to said operator side support of said anilox cylinder.

12. A distributor unit according to claim 10, further comprising:

an elastic means interposed between an appendix of said first element and said operator side support of said anilox cylinder.

13. A distributor unit according to claim 10, wherein said first and second elements are disposed on opposite sides in respect to said cliché cylinder.

14. A distributor unit according to claim 10, wherein said transmission side support holding said anilox cylinder and said transmission side support holding said cliché cylinder are independent from each other and respectively provided with an elastic stop and with a rigid stop.

15. A distributor unit according to claim 10, wherein said first element is provided with a concavity facing said cliché cylinder.

16. A distributor unit according to claim 10, wherein said first and second elements are disposed on opposite sides in respect to said cliché cylinder and said first element is provided with a concavity facing said cliché cylinder.

17. A distributor unit for cooperation with a transmission cylinder on which travels a web-shaped material which has to receive a substance, the distributor unit having an operator side and a transmission side, the distributor unit comprising:

a reservoir containing the substance;

an anilox cylinder;

a cliché cylinder onto which is movably fitted a cliché jacket, said reservoir, said anilox cylinder and said cliché cylinder being movable from and to said transmission cylinder;

an operator side support holding said anilox cylinder;

an operator side support holding said cliché cylinder;

a transmission side support holding said anilox cylinder;

a transmission side support holding said cliché cylinder;

a locking device for locking said cliché cylinder in a cantilever position in a substitution state when said corresponding cliché jacket has to be substituted, said locking device being associated with said transmission side support of said cliché cylinder, said operator side support of said cliché cylinder comprising a first element and a second element automatically movable from and to said cliché cylinder, said first and second elements holding said cliché cylinder on said operator side in a use state and said first and second elements are reciprocally spaced disengaging said operator side of said cliché cylinder in said substitution state;

an actuator associated with said second element for controlling movement of said second element from and to an axis of said cliché cylinder, said second element comprising a stop for limiting a movement of the distributor unit towards the transmission cylinder, wherein said transmission side support holding said anilox cylinder and said transmission side support holding said cliché cylinder are independent from each other and respectively provided with an elastic stop and with a rigid stop.

18. A distributor unit according to claim 17, wherein said first element is linked to said operator side support of said anilox cylinder by a linkage, whereby motion of said operator side support of said anilox cylinder causes movement of said first element.

19. A distributor unit according to claim 18, wherein said linkage between said first element and operator side support of said anilox cylinder comprises a lateral rigid appendix of said first element, said appendix being connected to said operator side support of said anilox cylinder.

20. A distributor unit according to claim 17, further comprising:

an elastic means interposed between an appendix of said first element and said operator side support of said anilox cylinder.

* * * * *